US007759039B2

(12) United States Patent
Veregin et al.

(10) Patent No.: US 7,759,039 B2
(45) Date of Patent: Jul. 20, 2010

(54) TONER CONTAINING SILICATE CLAY PARTICLES FOR IMPROVED RELATIVE HUMIDITY SENSITIVITY

(75) Inventors: Richard P. N. Veregin, Mississauga (CA); Daryl W. Vanbesien, Burlington (CA); Cuong Vong, Hamilton (CA)

(73) Assignee: Xerox Corporation, Norwalk, CT (US)

( * ) Notice: Subject to any disclaimer, the term of this patent is extended or adjusted under 35 U.S.C. 154(b) by 237 days.

(21) Appl. No.: 11/171,463

(22) Filed: Jul. 1, 2005

(65) Prior Publication Data

US 2007/0003855 A1 Jan. 4, 2007

(51) Int. Cl.
*G03G 9/093* (2006.01)

(52) U.S. Cl. ..... 430/110.2; 430/108.1; 430/108.3; 430/108.7; 430/137.12

(58) Field of Classification Search ..... 430/108.1, 430/108.3, 108.7, 110.2
See application file for complete search history.

(56) References Cited

U.S. PATENT DOCUMENTS

| | | | | |
|---|---|---|---|---|
| 4,338,390 | A | 7/1982 | Lu | |
| 4,340,660 | A | 7/1982 | Kiuchi et al. | |
| 5,278,020 | A | 1/1994 | Grushkin et al. | |
| 5,290,654 | A | 3/1994 | Sacripante et al. | |
| 5,308,734 | A | 5/1994 | Sacripante et al. | |
| 5,344,738 | A | 9/1994 | Kmiecik-Lawrynowicz et al. | |
| 5,346,797 | A | 9/1994 | Kmiecik-Lawrynowicz et al. | |
| 5,348,832 | A | 9/1994 | Kmiecik-Lawrynowicz et al. | |
| 5,364,729 | A | 11/1994 | Kmiecik-Lawrynowicz et al. | |
| 5,366,841 | A | 11/1994 | Patel et al. | |
| 5,370,963 | A | 12/1994 | Patel et al. | |
| 5,403,693 | A | 4/1995 | Patel et al. | |
| 5,405,728 | A | 4/1995 | Hopper et al. | |
| 5,418,108 | A | 5/1995 | Kmiecik-Lawrynowicz et al. | |
| 5,462,828 | A | 10/1995 | Moffat et al. | |
| 5,496,676 | A | 3/1996 | Croucher et al. | |
| 5,501,935 | A | 3/1996 | Patel et al. | |
| 5,527,658 | A | 6/1996 | Hopper et al. | |
| 5,585,215 | A | 12/1996 | Ong et al. | |
| 5,650,255 | A | 7/1997 | Ng et al. | |
| 5,650,256 | A | 7/1997 | Veregin et al. | |
| 5,744,520 | A | 4/1998 | Kmiecik-Lawrynowicz et al. | |
| 5,747,215 | A | 5/1998 | Ong et al. | |
| 5,763,133 | A | 6/1998 | Ong et al. | |
| 5,766,818 | A | 6/1998 | Smith et al. | |
| 5,804,349 | A | 9/1998 | Ong et al. | |
| 5,827,633 | A | 10/1998 | Ong et al. | |
| 5,840,462 | A | 11/1998 | Foucher et al. | |
| 5,853,944 | A | 12/1998 | Foucher et al. | |
| 5,869,215 | A | 2/1999 | Ong et al. | |
| 6,120,967 | A | 9/2000 | Hopper et al. | |
| 2002/0055580 | A1 * | 5/2002 | Lorah et al. | 524/445 |
| 2002/0058740 | A1 * | 5/2002 | Lorah et al. | 524/445 |
| 2003/0096185 | A1 * | 5/2003 | Yamashita et al. | 430/109.4 |
| 2004/0058266 | A1 | 3/2004 | Matsumura et al. | |
| 2004/0121256 | A1 * | 6/2004 | Suzuki et al. | 430/109.4 |
| 2004/0137352 | A1 | 7/2004 | McStravick et al. | |
| 2004/0137357 | A1 * | 7/2004 | Bartel et al. | 430/137.14 |
| 2005/0031980 | A1 | 2/2005 | Inoue et al. | |

FOREIGN PATENT DOCUMENTS

| | | | |
|---|---|---|---|
| EP | 1 050 782 | | 11/2000 |
| JP | 55-166653 | * | 12/1980 |
| JP | 08-339095 | * | 12/1996 |
| JP | 2002-244339 | * | 8/2002 |
| JP | 2003-186237 | * | 7/2003 |

* cited by examiner

*Primary Examiner*—Mark F Huff
*Assistant Examiner*—Peter L Vajda
(74) *Attorney, Agent, or Firm*—Oliff & Berridge, PLC

(57) ABSTRACT

Toner particles, preferably emulsion aggregation toner particles, have improved relative humidity sensitivity through inclusion therein of silicate clay particles such as kaolin clay. The toner particles include a binder, preferably an acrylate-containing binder, at least one colorant, and silicate clay particles distributed in the binder. In a core-shell embodiment, the silicate particles are distributed in the core, the shell layer, or both. Developers of the toner in combination with carrier particles are also described.

21 Claims, No Drawings

TONER CONTAINING SILICATE CLAY PARTICLES FOR IMPROVED RELATIVE HUMIDITY SENSITIVITY

BACKGROUND

Described herein are toners, and developers containing the toners, preferably emulsion aggregation toners, having improved sensitivity to relative humidity through inclusion of silicate clay particles, preferably aluminosilicate particles, in the toner particles.

Emulsion aggregation toners are excellent toners to use in forming print and/or xerographic images in that the toners can be made to have uniform sizes and in that the toners are environmentally friendly. U.S. patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215, each incorporated herein by reference in its entirety.

One main type of emulsion aggregation toner includes emulsion aggregation toners that are acrylate based, e.g., styrene acrylate toner particles. See, for example, U.S. Pat. No. 6,120,967, incorporated herein by reference in its entirety, as one example.

Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are optionally heated to enable coalescence/fusing, thereby achieving aggregated, fused toner particles.

U.S. Pat. No. 5,462,828 describes a toner composition that includes a styrene/n-butyl acrylate copolymer resin having a number average molecular weight of less than about 5,000, a weight average molecular weight of from about 10,000 to about 40,000 and a molecular weight distribution of greater than 6 that provides excellent gloss and high fix properties at a low fusing temperature.

A continuing issue with acrylate-based emulsion aggregation toners is that such toners typically incorporate a functional group, for example an acrylic acid, to stabilize the particles in the aqueous phase, thereby allowing the particles to be formed. The inclusion of such functional groups may result in the toner particles having a higher low relative humidity (RH) zone charge (low RH zone as used herein refers to a RH condition of 15% at a temperature of about 10° C.) than desired. While efforts to combat this effect have included increasing the externally additive coverage upon the external surface of the toner particles, such can have negative effects such as increased production costs, the need for increased minimum fusing temperatures, etc.

SUMMARY

Described herein are toner particles, preferably emulsion aggregation toner particles, having improved relative humidity sensitivity. In embodiments, the toner comprises a binder, preferably an acrylate-containing binder, at least one colorant, and silicate clay particles distributed in the binder.

In further embodiments, described are toners comprising toner particles having a core with a shell layer thereon, the core comprising a binder and at least one colorant, and the shell comprising a binder, and wherein the core binder, the shell binder, or both further includes silicate clay particles distributed therein.

In still further embodiments, described is a method of improving the relative humidity sensitivity of a toner comprised of a binder and at least one colorant, comprising including silicate clay particles in a toner binder, and forming the toner particle from the binder.

DETAILED DESCRIPTION OF EMBODIMENTS

The toner particles described herein are comprised of polymer binder, at least one colorant, and silicate clay particles that are distributed throughout the binder. A wax may also preferably be included in the toner particles.

In embodiments, the polymer binder preferably includes an acrylate-containing polymer binder. Illustrative examples of specific polymer resins for the binder include, for example, poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and other similar polymers.

Preferably, the binder includes a styrene-alkyl acrylate binder. More preferably, the styrene-alkyl acrylate is a styrene-butyl acrylate copolymer resin, and most preferably, a styrene-butyl acrylate β-carboxyethyl acrylate polymer resin. In a preferred embodiment, the styrene-butyl acrylate β-carboxyethyl acrylate polymer is comprised of about 70 to about 85% styrene, about 12 to about 25% butyl acrylate, and about 1 to about 10% β-carboxyethyl acrylate.

The monomers (including oligomers) used in making the polymer binder are not limited, and the monomers utilized may include any one or more of, for example, styrene, acrylates, including methacrylates, butylacrylates, α-carboxyethyl acrylate (β-CEA), etc., butadiene, isoprene, acrylic acid, methacrylic acid, itaconic acid, acrylonitrile, benzenes such as divinylbenzene, etc., and the like. Known chain transfer agents can be utilized to control the molecular weight properties of the polymer. Examples of chain transfer agents include dodecanethiol, dodecylmercaptan, octanethiol, carbon tetrabromide, carbon tetrachloride, and the like in various suitable amounts, for example of about 0.1 to about 10 percent by weight of all monomers, and preferably of about 0.2 to about 5 percent by weight of the monomers. Also, crosslinking agents such as decanedioldiacrylate or divinylbenzene may be included in the monomer system in order to obtain higher molecular weight polymers, for example in an effective amount of about 0.01 percent by weight to about 25 percent by weight, preferably of about 0.5 to about 10 percent by weight.

In a preferred embodiment, the monomer components, with any of the aforementioned optional additives, are preferably formed into a latex emulsion and then polymerized to form small sized polymer particles, for example on the order of about 5 nm to about 500 nm. The monomers and agents may be formed into a latex emulsion with or without the use of suitable surfactants, as necessary. Of course, any other suitable method for forming the latex polymer particles from the monomers may be used without restriction.

In embodiments, the binder may be comprised of a mixture of two binder materials of differing molecular weights, such that the binder has a bimodal molecular weight distribution (i.e., molecular weight peaks at least at two different molecular weight regions). For example, in one embodiment, the binder is comprised of a first lower molecular weight binder and a second high molecular weight binder. The first binder preferably has a number average molecular weight (Mn), as measured by gel permeation chromatography (GPC), of from, for example, about 1,000 to about 30,000, and more specifically from about 5,000 to about 15,000, a weight average molecular weight (Mw) of from, for example, about 1,000 to about 75,000, and more specifically from about 25,000 to about 40,000, and a glass transition temperature of from, for example, about 40° C. to about 75° C. The second binder preferably has a substantially greater number average and weight average molecular weight, for example over 1,000,000 for Mw and Mn, and a glass transition temperature of from, for example, about 35° C. to about 75° C. The glass transition temperature may be controlled, for example by adjusting the amount acrylate in the binder. For example, a higher acrylate content can reduce the glass transition temperature of the binder. The second binder may be referred to as a gel, i.e., a highly crosslinked polymer, due to the extensive gelation and high molecular weight of the latex. In this embodiment, the gel binder may be present in an amount of from about 0% to about 50% by weight of the total binder, preferably from about 8% to about 35% by weight of the total binder.

The gel portion of the binder distributed throughout the first binder can be used to control the gloss properties of the toner. The greater the amount of gel binder, the lower the gloss in general.

Both polymeric binders may be derived from the same monomer materials, but made to have different molecular weights, for example through inclusion of a greater amount of crosslinking in the higher molecular weight polymer. The first, lower molecular weight binder may be selected from among any of the aforementioned polymer binder materials. The second gel binder may be the same as or different from the first binder. For example, the second gel binder may be comprised of highly crosslinked materials such as poly(styrene-alkyl acrylate), poly(styrene-butadiene), poly(styrene-isoprene), poly(styrene-alkyl methacrylate), poly(styrene-alkyl acrylate-acrylic acid), poly(styrene-alkyl methacrylate-acrylic acid), poly(alkyl methacrylate-alkyl acrylate), poly (alkyl methacrylate-aryl acrylate), poly(aryl methacrylate-alkyl acrylate), poly(alkyl methacrylate-acrylic acid), poly (styrene-alkyl acrylate-acrylonitrileacrylic acid), and poly (alkyl acrylate-acrylonitrile-acrylic acid), and/or mixtures thereof. In a preferred embodiment, the gel binder is the same as the first binder, and both are a styrene acrylate, preferably styrene-butyl acrylate. The higher molecular weight of the second gel binder may be achieved by, for example, including greater amounts of styrene in the monomer system, including greater amounts of crosslinking agent in the monomer system and/or including lesser amounts of chain transfer agents.

Preferably, the gel latex comprises submicron crosslinked resin particles of about 10 to about 400 nanometers, more preferably about 20 to about 250 nanometers, suspended in an aqueous water phase containing a surfactant.

In a further embodiment, the toner particles have a core-shell structure. In this embodiment, the core is comprised of the toner particle materials, including at least the binder and the colorant. Once the core particle is formed and aggregated to a desired size, a thin outer shell is then formed upon the core particle. The shell is preferably comprised of only binder material, although other components may be included therein if desired. The silicate clay particles may be distributed in the core binder, the shell layer binder, or both.

The shell is preferably comprised of a latex resin that is the same as a latex of the core particle, although the shell is preferably free of gel latex resin. Although the shell latex may be comprised of any of the polymers identified above, it is preferably a styrene acrylate polymer, most preferably a styrene-butyl acrylate polymer. The shell latex may be added to the toner aggregates in an amount of about 5 to about 40 percent by weight of the total binder materials, and preferably in an amount of about 5 to about 30 percent by weight of the total binder materials. Preferably, the shell or coating on the toner aggregates has a thickness of about 0.2 to about 1.5 μm, preferably about 0.5 to about 1.0 μm.

The total amount of binder, including core and shell if present, is preferably an amount of from about 60 to about 95% by weight of the toner particles (i.e., the toner particles exclusive of external additives) on a solids basis, preferably from about 70 to about 90% by weight of the toner.

Various suitable colorants can be employed, including suitable colored pigments, dyes, and mixtures thereof. Suitable examples include, for example, carbon black such as REGAL 330 carbon black, acetylene black, lamp black, aniline black, Chrome Yellow, Zinc Yellow, SICOFAST Yellow, SUNBRITE Yellow, LUNA Yellow, NOVAPERM Yellow, Chrome Orange, BAYPLAST Orange, Cadmium Red, LITHOL Scarlet, HOSTAPERM Red, FANAL PINK, HOSTAPERM Pink, LUPRETON Pink, LITHOL Red, RHODAMINE Lake B, Brilliant Carmine, HELIOGEN Blue, HOSTAPERM Blue, NEOPAN Blue, PV Fast Blue, CINQUASSI Green, HOSTAPERM Green, titanium dioxide, cobalt, nickel, iron powder, SICOPUR 4068 FF, and iron oxides such as MAPICO Black (Columbia) NP608 and NP604 (Northern Pigment), BAYFERROX 8610 (Bayer), M08699 (Mobay), TMB-100 (Magnox), mixtures thereof and the like.

The colorant, preferably carbon black, cyan, magenta and/or yellow colorant, is incorporated in an amount sufficient to impart the desired color to the toner. In general, pigment or dye is employed in an amount ranging from about 2% to about 35% by weight of the toner particles on a solids basis, preferably from about 4% to about 25% by weight and more preferably from about 4% to about 15% by weight of the toner particles on a solids basis. Of course, as the colorants for each color are different, the amount of colorant present in each type of color toner typically is different.

In addition to the latex polymer binder and the colorant, the toners also preferably contain a wax dispersion. The wax is added to the toner formulation in order to aid toner offset resistance, e.g., toner release from the fuser roll, particularly in low oil or oil-less fuser designs. For emulsion aggregation (EA) toners, for example styrene-acrylate EA toners, linear polyethylene waxes such as the POLYWAX® line of waxes available from Baker Petrolite are useful. Of course, the wax dispersion may also comprise polypropylene waxes, other waxes known in the art, and mixtures of waxes.

To incorporate the wax into the toner, it is preferable for the wax to be in the form of an aqueous emulsion or dispersion of solid wax in water, where the solid wax particle size is usually in the range of from about 100 to about 500 nm.

The toners may contain from, for example, about 5 to about 15% by weight of the toner, on a solids basis, of the wax. Preferably, the toners contain from about 8 to about 12% by weight of the wax.

Silicate clay particles are also added to the toner particle so as to be distributed in the binder of the toner particle. The silicate clay particles may be distributed in the binder of one or both of the toner core particle and shell layer in a core-shell toner particle structure. As a preferred silicate clay, aluminosilicate clay may be mentioned, including kaolin clay. Kaolin clay is also known as China clay or Paper clay. It is composed of the mineral kaolinite, an aluminosilicate, and is a hydrated silica of alumina with a composition of about 46% silica, about 40% alumina and about 14% water. Examples of suitable kaolin clay particles are Huber 80, Huber 90, Polygloss 80 and Polygloss 90. Other suitable examples of natural refined kaolin clay are DIXIECLAY®, PAR®, and BILTPLATES® 156 from R.T. Vanderbilt Company, Inc.

As with kaolin clay, the silicate clay is preferably hydrated. The silicate clay may also be treated with an inorganic or organic material.

Other silicate clays that can be utilized include Bentonite Clay, such as magnesium silicate, also known as Hectorite. Alternatively, the silicate clay may be a magnesium aluminum silicate, also known as Montmorillonite. Examples of magnesium aluminum silicate clays include natural refined silicates such as GELWHITE® MAS 100(SC), GELWHITE® MAS 101, GELWHITE® MAS 102 AND GELWHITE® MAS 103, GELWHITE® L, GELWHITE® GP, BENTOLITE® MB, and CLOISITE® Na+, from Rockwood Additives Ltd. (UK). The magnesium aluminum silicate clay may also be treated by an organic agent, such as CLOISITE® 10A, 15A, 20A, 25A, 30B and 93A which are natural montmorillonite modified with a quaternary ammonium salt, or CLAYTONE® HY, CLAYTONE® SO, all available from Rockwood Additives Ltd. (UK). Other organic modified montmorillonites are, for example, CLAYTONE® 40, APA, AF, HT, HO, TG, HY, and 97 from Rockwood Additives Ltd. (UK). Examples of magnesium silicates include, for example, synthetic layered magnesium silicates such as LAPONITE RD, LAPONITE RDS (that incorporates an inorganic polyphosphate peptiser), LAPONITE B (a fluorosilicate), LAPONITE S (a fluorosilicate incorporating an inorganic polyphosphate peptiser), LAPONITE D and DF (surface modified with fluoride ions), and LAPONITE JS (a fluorosilicate modified with an inorganic polyphosphate dispersing agent), all from Rockwood Additives Ltd. (UK).

The silicate clay particles preferably have a small size, for example on the order of from about 5 nm to about 500 nm, preferably from about 10 nm to about 200 nm, on average. Further, the silicate clay particles may have a specific surface area of from about 10 to about 400 $m^2/g$, preferably from about 15 to about 200 $m^2/g$.

To be added to an emulsion aggregation toner process, the silicate clay particles are preferably made into a dispersion, for example by dispersing the silicate clay particles in water, with or without the use of surfactants, to form an aqueous dispersion. The solids content of the dispersion is not limited, but is preferably from about 5 to about 35% of the dispersion.

The silicate clay particles are preferably included in the toner particles in a total amount (e.g., including amounts in both a core and shell layer in core-shell structures) of from about 2 to about 15% by weight of the toner particles, preferably in an amount of from about 3 to about 10% by weight of the toner particles.

By including the silicate clay particles in the toner particle formation process, the silicate clay particles can be made to be distributed in the binder of the toner particle, including in either or both of a toner core and a shell layer in a core-shell structure. Preferably, the silicate clay particles are distributed substantially uniformly throughout the toner binder and/or toner core particle and/or toner shell layer.

The silicate clay particle presence has been found to improve the toner particles RH sensitivity, particularly in the low humidity RH zone. As a result, the low humidity RH zone charge of the toner is substantially improved, and the RH sensitivity ratio, i.e., the ratio of the toner's charge in a high humidity RH zone to the toner's charge in a low humidity RH zone, is substantially improved. The silicate clay is thus able to effectively address the effects of the presence of acrylic acid functional groups in the toner binder.

The toners may also optionally contain a coagulant and/or a flow agent such as colloidal silica. Suitable optional coagulants include any coagulant known or used in the art, including the well known coagulants polyaluminum chloride (PAC) and/or polyaluminum sulfosilicate (PASS). A preferred coagulant is polyaluminum chloride. The coagulant is present in the toner particles, exclusive of external additives and on a dry weight basis, in amounts of from 0 to about 3% by weight of the toner particles, preferably from about greater than 0 to about 2% by weight of the toner particles. The flow agent, if present, may be any colloidal silica such as SNOWTEX OL/OS colloidal silica. The colloidal silica is present in the toner particles, exclusive of external additives and on a dry weight basis, in amounts of from 0 to about 15% by weight of the toner particles, preferably from about greater than 0 to about 10% by weight of the toner particles.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

In preparing the toner by the emulsion aggregation procedure, one or more surfactants may be used in the process. Suitable surfactants include anionic, cationic and nonionic surfactants.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, the DOWFAX brand of anionic surfactants, and the NEOGEN brand of anionic surfactants. An example of a preferred anionic surfactant is NEOGEN RK available from Daiichi Kogyo Seiyaku Co. Ltd., which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a preferred cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a preferred nonionic surfactant is ANTAROX 897 available from Rhone-Poulenc Inc., which consists primarily of alkyl phenol ethoxylate.

Any suitable process may be used to form the toner particles without restriction. In a preferred embodiment, an emulsion aggregation procedure may be used in forming emulsion aggregation toner particles. Emulsion aggregation procedures typically include the basic process steps of at least aggregating the latex emulsion containing binder(s), the one or more colorants, the silicate clay particles, optionally one or more surfactants, optionally a wax emulsion, optionally a coagulant and one or more additional optional additives to form aggregates, optionally forming a shell on the aggregated core particles, subsequently optionally coalescing or fusing the aggregates, and then recovering, optionally washing and optionally drying the obtained emulsion aggregation toner particles.

An example emulsion/aggregation/coalescing process preferably includes forming a mixture of latex binder, colorant dispersion, silicate clay particle dispersion, optional wax emulsion, optional coagulant and deionized water in a vessel. The mixture is stirred using a homogenizer until homogenized and then transferred to a reactor where the homogenized mixture is heated to a temperature of, for example, at least about 45° C. and held at such temperature for a period of time to permit aggregation of toner particles to a desired size. Additional latex binder may then be added to form a shell upon the aggregated core particles. Once the desired size of aggregated toner particles is achieved, the pH of the mixture is adjusted in order to inhibit further toner aggregation. The toner particles are further heated to a temperature of, for example, at least about 90° C., and the pH lowered in order to enable the particles to coalesce and spherodize. The heater is then turned off and the reactor mixture allowed to cool to room temperature, at which point the aggregated and coalesced toner particles are recovered and optionally washed and dried.

Most preferably, following coalescence and aggregation, the particles are wet sieved through an orifice of a desired size in order to remove particles of too large a size, washed and treated to a desired pH, and then dried to a moisture content of, for example, less than 1% by weight.

In embodiments, the toner particles preferably have an average particle size of from about 1 to about 15 μm, preferably from about 5 to about 9 μm. The particle size may be determined using any suitable device, for example a conventional Coulter counter. The circularity may be determined using the known Malvern Sysmex Flow Particle Image Analyzer FPIA-2100.

The toner particles also preferably have a size such that the upper geometric standard deviation by volume (GSDv) for (D84/D50) is preferably in the range of from about 1.15 to about 1.25. The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). The upper GSDv value for the toner particles indicates that the toner particles are preferably made to have a very narrow particle size distribution.

It may also be desirable to control the toner particle size and limit the amount of both fine and coarse toner particles in the toner. The toner particles may have a very narrow particle size distribution with a lower number ratio geometric standard deviation (GSDn), for example of from about 1.20 to about 1.30.

The toner particles are preferably blended with external additives following formation. Any suitable surface additives may be used. Preferred external additives include one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is preferably also used as an external additive for the toners of the invention, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate known as Zinc Stearate L, obtained from Ferro Corporation. The external surface additives can be used with or without a coating.

Most preferably, the toners contain from, for example, about 0.5 to about 5 weight percent titania (size of from about 10 nm to about 50 nm, preferably about 40 nm), about 0.5 to about 5 weight percent silica (size of from about 10 nm to about 50 nm, preferably about 40 nm), about 0.5 to about 5 weight percent spacer particles.

Surface treated silicas that can be utilized include, for example, TS-530 from Cabosil Corporation, with an 8 nanometer particle size and a surface treatment of hexamethyldisilazane; NAX50 obtained from DeGussa/Nippon Aerosil Corporation, coated with HMDS; H2050EP obtained from Wacker Chemie, coated with an amino functionalized organopolysiloxane; CAB-O-SIL® fumed silicas such as for example TG-709F, TG-308F, TG-810G, TG-81° F., TG-822F, TG-824F, TG-826F, TG-828F or TG-829F with a surface area from 105 to 280 $m^2/g$ obtained from Cabot Corporation; PDMS-surface treated silicas such as for example RY50, NY50, RY200, RY200S and R202, all available from Nippon Aerosil, and the like. Such conventional surface treated silicas are applied to the toner surface for toner flow, triboelectric charge enhancement, admix control, improved development and transfer stability, and higher toner blocking temperature.

Surface treated titania materials that are suitable include, for example, MT-3103 from Tayca Corp. with a 16 nanometer particle size and a surface treatment of decylsilane; SMT5103 obtained from Tayca Corporation or Degussa Chemicals and comprised of a crystalline titanium dioxide core; MT500B coated with DTMS (decyltrimethoxysilane); P-25 from Degussa Chemicals with no surface treatment; an isobutyltrimethoxysilane (i-BTMS) treated hydrophobic titania obtained from Titan Kogyo Kabushiki Kaisha (IK Inabata America Corporation, New York); and the like. Such surface treated titanias are applied to the toner surface for improved relative humidity (RH) stability, triboelectric charge control and improved development and transfer stability. The decyltrimethoxysilane (DTMS) treated titania is particularly preferred in some embodiments.

A third preferred component of the additive package is a spacer particle. Spacer particles, particularly latex or polymer spacer particles, are described in, for example, U.S. Patent Application Publication No. 2004-0137352 A1, the entire disclosure of which is incorporated herein by reference.

In one embodiment, the spacer particles are comprised of latex particles. Any suitable latex particles may be used without limitation. As examples, the latex particles may include rubber, acrylic, styrene acrylic, polyacrylic, fluoride, or polyester latexes. These latexes may be copolymers or crosslinked polymers. Specific examples include acrylic, styrene acrylic and fluoride latexes from Nippon Paint (e.g., FS-101, FS-102, FS-104, FS-201, FS-401, FS-451, FS-501, FS-701, MG-151 and MG-152) with particle diameters in the range from 45 to 550 nm, and glass transition temperatures in the range from 65° C. to 102° C. These latex particles may be derived by any conventional method in the art. Suitable polymerization methods may include, for example, emulsion polymerization, suspension polymerization and dispersion polymerization, each of which is well known to those versed in the art. Depending on the preparation method, the latex particles may have a very narrow size distribution or a broad size distribution. In the latter case, the latex particles prepared may be classified so that the latex particles obtained have the appropriate size to act as spacers as discussed above. Commercially available latex particles from Nippon Paint have very narrow size distributions and do not require post-processing classification (although such is not prohibited if desired).

In a further embodiment, the spacer particles may also comprise polymer particles. Any type of polymer may be used to form the spacer particles of this embodiment. For example, the polymer may be polymethyl methacrylate (PMMA), e.g., 150 nm MP1451 or 300 nm MP116 from Soken Chemical Engineering Co., Ltd. with molecular weights between 500 and 1500K and a glass transition temperature onset at 120° C., fluorinated PMMA, KYNAR® (polyvinylidene fluoride), e.g., 300 nm from Pennwalt, polytetrafluoroethylene (PTFE), e.g., 300 nm L2 from Daikin, or melamine, e.g., 300 nm EPOSTAR-S® from Nippon Shokubai.

In a preferred embodiment, the spacer particles are large sized silica particles. Thus, preferably, the spacer particles have an average particle size greater than an average particles size of the silica and titania materials discussed above. For example, the spacer particles in this embodiment are sol-gel silicas. Examples of such sol-gel silicas include, for example, X24, a 150 nm sol-gel silica surface treated with hexamethyldisilazane, available from Shin-Etsu Chemical Co., Ltd.

The toner particles can optionally be formulated into a developer composition by mixing the toner particles with carrier particles. Illustrative examples of carrier particles that can be selected for mixing with the toner composition include those particles that are capable of triboelectrically obtaining a charge of opposite polarity to that of the toner particles. Accordingly, in one embodiment, the carrier particles may be selected so as to be of a positive polarity in order that the toner particles that are negatively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like.

A preferred carrier herein is a magnetite core, from about 35 to 75 μm in size, coated with about 0.5% to about 5% by weight, and preferably about 1.5% by weight of a conductive polymer mixture comprised on methylacrylate and carbon black. Alternate preferred carrier cores are iron ferrite cores of about 35 to 75 micron in size, or steel cores, for example of about 50 to about 75 μm in size.

The carrier particles can be mixed with the toner particles in various suitable combinations. The concentrations are usually about 1% to about 20% by weight of toner and about 80% to about 99% by weight of carrier. However, one skilled in the art will recognize that different toner and carrier percentages may be used to achieve a developer composition with desired characteristics.

The toners can be used in known electrostatographic imaging methods. Thus for example, the toners or developers can be charged, e.g., triboelectrically, and applied to an oppositely charged latent image on an imaging member such as a photoreceptor or ionographic receiver. The resultant toner image can then be transferred, either directly or via an intermediate transport member, to an image receiving substrate such as paper or a transparency sheet. The toner image can then be fused to the image receiving substrate by application of heat and/or pressure, for example with a heated fuser roll.

The toner will now be further described via the following example.

Preparation of silicate clay particle dispersion: 80 grams of kaolin clay (POLYGLOSS 80 from Huber) as the aluminosilicate was added with 2 grams of DOWFAX 2A1 and 400 grams of deionized water. The solution is ball milled using steel shot for 15 hours. The resulting solution is screened to separate out the steel shot. The resulting dispersion has a solids content of 16.7 weight percent.

Preparation of toner with 5 weight percent silicate clay: 164.4 grams of a styrene/butyl acrylate/β-carboxyethyl acrylate (β-CEA) polymer latex (latex 1) having a solids content of 41.6 weight percent and 66.98 grams of POLYWAX 725 wax emulsion having a solids content of 30.3 weight percent are added to 506.1 grams of deionized water and stirred using a homogenizer operating at 4,000 rpm. Then 90.27 grams of REGAL 330 carbon black pigment dispersion (solids of 17 weight percent), 72 grams of styrene/butyl acrylate/β-carboxyethyl acrylate (β-CEA) polymer gel latex (latex 2) having a solids content of 25 weight percent and 54.12 grams of the silicate clay dispersion are added to the mixture, followed by drop-wise addition of 30.6 grams of a coagulant mixture containing 3.06 grams of polyaluminum chloride (PAC) and 27.54 grams of 0.02 molar nitric acid solution. As the coagulant is added, the homogenizer speed is increased to 5,200 rpm and homogenization continues for 5 minutes. The mixture is then heated to 49° C. and held for about 1.5 to 2 hours at a stirrer speed of about 220 to about 250 rpm. An additional 121.2 grams of latex 1 is then added to the reactor mixture and allowed to aggregate for an additional 30 minutes at 49° C., forming a shell on the core particles and achieving particles having an overall volume average particle diameter of about 5.7 microns. The mixture was adjusted in pH to 6 with 1 M sodium hydroxide to stop aggregation. The mixture was then heated to 95° C., followed by adjusting the pH to 3.9 with 0.3 M nitric acid solution. Gentle stirring is continued for 5 hours to coalesce and spherodize the particles. Once a desired shape, as monitored on a Sysmex FPIA shape analyzer, is achieved, the pH is brought to 7.0. After completion of the full 5 hours, the reactor is turned off and the mixture cooled to room temperature.

The resulting toner mixture is comprised of about 16.7% toner, about 0.25% anionic surfactant and about 83% water. The toner is comprised of about 66% latex 1 polymer, about 10% gel latex (latex 2) polymer, about 8% carbon black colorant, about 5% silicate clay and about 11% wax, all percentages by weight. The toner particles have a volume average particle diameter of about 5.7 microns and a GSDv of about 1.19

The particles are washed six times, the first wash at pH of 10 and 63° C., the next three washes with deionized water at room temperature, the next wash at pH of 4 and 40° C., and the final wash with deionized water at room temperature.

Charging evaluation: Developers are prepared in 60 mL glass bottles at 4% toner concentration by mixing 0.4 grams toner with 10 grams of carrier particles comprised of 65 micron size magnetite particles coated with 1.6 wt % PMMA polymer containing 10 wt % carbon black. A portion of the developer is conditioned in a high RH zone (RH of 85% at a temperature of about 28° C.) and another portion conditioned in a low RH zone, both overnight. Toner charge (Q/D) is measured on the charge spectrograph at 60 minutes of charging.

Charging results: The toner charge was measured on a charge spectrograph operating with a perpendicular electric field of 100 V/cm and a column length of 30 cm. The charge is measured as the average displacement in mm of the toner from a zero charge spot. The toner charge can also be expressed in units of femto coulombs per micron by multiplying the displacement in mm by the factor of 0.092. The example toner exhibited a low RH zone charge of −4.8 mm and a high RH zone charge of −2.3 mm (and thus a ratio of high to low RH zone of 0.48). As a comparative example, the same toner is prepared, with the exception that the silicate clay particles are omitted in the comparative toner. The comparative toner exhibits a low RH zone charge of −10.2 mm and a high RH zone charge of −2.6 mm (and thus a high to low RH zone ratio of 0.25). Clearly, the toner including the silicate clay particles has dramatically reduced low RH zone charge with little effect on the high RH zone charge. The silicate clay containing toner also has much improved RH sensitivity, as confirmed by the improved high to low RH zone ratio (it is desirable to have the measured ratio be closer to about 1 to obtain more ideal RH sensitivity).

It will be appreciated that various of the above-disclosed and other features and functions, or alternatives thereof, may be desirably combined into many other different systems or applications. Also, various presently unforeseen or unanticipated alternatives, modifications or improvements therein may be subsequently made by those skilled in the art, and are also intended to be encompassed by the following claims.

What is claimed is:

1. An emulsion aggregation toner comprising toner particles having a core with a shell layer thereon, the core comprising a binder and at least one colorant, and the shell comprising a binder, wherein silicate clay particles of a silicate clay particle dispersion are distributed only in the core binder, wherein the silicate clay particles have an average particle size from about 5 nm to about 500 nm and a surface area from about 10 $m^2/g$ to about 400 $m^2/g$, wherein the toner particles have an average particle size from about 5 to about 9 μm, and wherein the core is derived from an emulsion comprised of the binder as a latex of polymerized binder, the at least one colorant as a colorant dispersion, and the silicate clay particle dispersion.

2. The toner according to claim 1, wherein the toner particles further comprise a wax dispersion.

3. The toner according to claim 1, wherein the silicate clay particles are aluminosilicate clay particles.

4. The toner according to claim 1, wherein the silicate clay particles are kaolin clay particles.

5. The toner according to claim 1, wherein the silicate clay particles comprise about 2% to about 15% by weight of the toner.

6. The toner according to claim 1, wherein the silicate clay particles are hydrated.

7. A developer comprising the toner according to claim 1 and carrier particles.

8. The toner according to claim 1, wherein the silicate clay particles are treated with an inorganic material or an organic material.

9. The toner according to claim 1, wherein the silicate clay particles include at least one of magnesium silicate particles, magnesium aluminum silicate particles, natural montmorillonite particles modified with a quaternary ammonium salt, organic modified montmorillonite particles, synthetic layered magnesium silicate particles, synthetic layered magnesium silicate particles incorporating an inorganic polyphosphate peptiser, fluorosilicate particles, fluorosilicate particles incorporating an inorganic polyphosphate peptiser, and fluorosilicate particles modified with an inorganic polyphosphate dispersing agent.

10. The toner according to claim 1, wherein the silicate clay particles have an average particle size from about 10 nm to about 200 nm and a surface area from about 15 $m^2/g$ to about 200 $m^2/g$.

11. The toner according to claim 1, wherein the binder of the core and/or the shell includes an acrylic acid functional group.

12. The toner according to claim 1, wherein the binder of the core and/or the shell includes an acrylate-containing polymer.

13. The toner according to claim 12, wherein the acrylate-containing polymer is a styrene-alkyl acrylate.

14. The toner according to claim 13, wherein the styrene-alkyl acrylate polymer is a styrene-butyl acrylate.

15. The toner according to claim 12, wherein the binder of the core and/or the shell further comprises an acrylate-containing gel latex.

16. The toner according to claim 15, wherein the acrylate-containing gel comprises from about 8% to about 35% by weight of the total binder.

17. The toner according to claim 12, wherein the shell consists essentially of an acrylate-containing polymer.

18. The toner according to claim 17, wherein the acrylate-containing polymer of the shell and the acrylate-containing polymer of the binder of the core are the same.

19. A xerographic imaging apparatus comprising an image forming station and a housing containing the toner according to claim 1.

20. A method of improving the relative humidity sensitivity of an emulsion aggregation toner having a core with a shell layer thereon, the core comprising a binder and at least one colorant and the shell comprising a binder, the method comprising:

forming a silicate clay particle dispersion comprised of silicate clay particles, water and optional surfactants, forming the core from the binder, the at least one colorant and the silicate clay particle dispersion, and then forming the shell thereon, wherein the silicate clay particles have an average particle size from about 5 nm to about 500 nm and a surface area from about 10 $m^2/g$ to about 400 $m^2/g$, wherein the silicate clay particles of the silicate clay particle dispersion are distributed only in the core binder, and wherein the toner particles have an average particle size from about 5 to about 9 μm.

21. The method according to claim 20, wherein the silicate clay particles are introduced as a dispersion into an aggregation phase of toner particle formation.

* * * * *